US006796462B2

(12) United States Patent
Hudson et al.

(10) Patent No.: US 6,796,462 B2
(45) Date of Patent: Sep. 28, 2004

(54) CHILD-RESISTANT FLUID DELIVERY DEVICE

(75) Inventors: William A. Hudson, Fox Point, WI (US); Raymond Cracauer, Middleton, WI (US)

(73) Assignee: H. D. Hudson Manufacturing Company, Chicago, IL (US)

( * ) Notice: Subject to any disclaimer, the term of this patent is extended or adjusted under 35 U.S.C. 154(b) by 0 days.

(21) Appl. No.: 10/695,218

(22) Filed: Oct. 27, 2003

(65) Prior Publication Data

US 2004/0129728 A1 Jul. 8, 2004

Related U.S. Application Data

(63) Continuation of application No. 09/850,251, filed on May 7, 2001, now Pat. No. 6,666,354.
(60) Provisional application No. 60/203,721, filed on May 12, 2000.

(51) Int. Cl.[7] ..... B67B 5/00
(52) U.S. Cl. ..... 222/147; 222/529; 222/543; 215/206
(58) Field of Search ..... 222/153.02, 543, 222/529–530, 147, 153.09, 153; 215/206, 901

(56) References Cited

U.S. PATENT DOCUMENTS 1,983,101 A 12/1934 Scriber
3,563,206 A 2/1971 Hermann
3,584,769 A 6/1971 Pinke
3,670,966 A 6/1972 Korda
3,893,630 A 7/1975 Bochmann et al.
3,901,449 A 8/1975 Bochmann
3,924,768 A 12/1975 Lemons
4,241,856 A 12/1980 Otterson (List continued on next page.)

OTHER PUBLICATIONS

Catalog 86181 entitled "Hudson Professional Sprayers and Dusters", 8 pages.

International Search Report, mailed on Sep. 4, 2001, in connection with corresponding International Application No. PCT/US01/14605 corresponding to parent application Ser. No. 09/850,251, filed May 7, 2001.

*Primary Examiner*—Philippe Derakshani
(74) *Attorney, Agent, or Firm*—Morgan & Finnegan, LLP

(57) ABSTRACT

A child-resistant fluid delivery device, comprising a container for storing fluid to be dispensed by the fluid delivery device and a wand assembly connected to the container. The wand assembly having a nozzle at a distal end through which fluid may be dispensed and a child-resistant connector at a proximal end. A ratchet mechanism is formed on the exterior of the child-resistant connector to permit attachment of the connector to the container and thereafter prevent removal of the connector from the container. The nozzle is sealed by a removable, child-resistant cover that includes at least one member that engages the nozzle to resist removal therefrom.

29 Claims, 9 Drawing Sheets

U.S. PATENT DOCUMENTS 4,281,778 A 8/1981 Stull
4,426,027 A 1/1984 Maynard, Jr.
4,494,878 A 1/1985 Jacobi
4,509,664 A 4/1985 Petersen
4,664,301 A 5/1987 Hoyt
D298,015 S 10/1988 Gendron et al.
4,832,238 A 5/1989 Taylor
4,933,569 A 6/1990 Merchlewitz
5,120,148 A 6/1992 Waters et al.
5,152,314 A 10/1992 Yandle, III
5,303,869 A 4/1994 Hudson, Jr.
D350,589 S 9/1994 Hudson
D351,213 S 10/1994 Hudson, Jr.
5,370,279 A 12/1994 Tardif
5,435,469 A 7/1995 Gager et al.
D369,111 S 4/1996 Brass et al.
5,598,955 A 2/1997 Reilley
5,607,082 A 3/1997 Cracauer
5,609,272 A 3/1997 Brass et al.
5,624,061 A 4/1997 Gager et al.
5,649,664 A 7/1997 Brass et al.
5,657,905 A 8/1997 Glynn
5,676,314 A 10/1997 Brass et al.
5,678,768 A 10/1997 Gager et al.
5,699,922 A 12/1997 Harding
5,924,633 A 7/1999 Brass et al.
5,927,527 A 7/1999 Montgomery et al.
6,039,195 A 3/2000 Konefal et al.
6,053,343 A 4/2000 Krueger
6,155,497 A 12/2000 Hudson, Jr. et al.
6,666,354 B2 * 12/2003 Hudson et al. ..... 222/147

* cited by examiner

CHILD-RESISTANT FLUID DELIVERY DEVICE

CROSS-REFERENCE TO RELATED APPLICATION

This application is a continuation of application Ser. No. 09/850,251, filed May 7, 2001 now U.S. Pat. No. 6,666,354, which claims the benefit of U.S. Provisional Application No. 60/203,721, filed May 12, 2000.

BACKGROUND OF THE INVENTION

1. Field of the Invention

The present invention relates to fluid delivery devices, and more particularly, to one-time use, limited use and reusable child-resistant fluid delivery devices that develop pressure by depressing or squeezing the container/device.

2. Description of the Related Art

There are a number of different types of fluid delivery devices available for use in a wide variety of applications, including fluid delivery devices or sprayers that dispense fluids or other liquid solutions from a reservoir, tank or container through an outlet hose, extension rod, or wand on which a discharge nozzle is mounted. In these devices, the fluid is generally discharged under pressure by, for example, depressing or squeezing the container/device, or, alternatively, pressurizing the interior of the container using an internally mounted piston/cylinder pump.

In many applications, the fluid or other liquid solution to be dispensed from the device may be a chemical or other concentrated solution—such as pesticides, insecticides, industrial, agricultural and garden chemicals—that may be toxic, hazardous or otherwise ecologically undesirable. Accordingly, it is desirable to provide such fluid delivery devices with protective, child-resistant features that will minimize or avoid accidental exposure of a child to the contents of the fluid delivery device.

SUMMARY OF THE INVENTION

Several alternative embodiments of the child-resistant fluid delivery device of the present invention are illustrated in the drawings and described below. The child-resistant elements of the fluid delivery device include: (1) a child-resistant fill cap that may not be removed from the container without destroying the fill cap; (2) a non-child resistant shipping cap that may include a child-resistant overwrap requiring removal by the user prior to assembling the wand assembly; (3) a push/pull shut-off valve for controlling the flow of fluid from the container through the wand assembly; and (4) a child-resistant cover for sealing a nozzle at the distal end of the wand assembly, which cover may only be removed from the nozzle by physical manipulation of the cover.

The foregoing specific objects and advantages of the invention are illustrative of those that can be achieved by the present invention and are not intended to be exhaustive or limiting of the possible advantages which can be realized. Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF DRAWINGS

The foregoing features and other aspects of the invention are explained in the following description taken in connection with the accompanying drawings wherein.

DETAILED DESCRIPTION

In accordance with the present invention, a fluid delivery device is provided with child-resistant features to prevent or minimize the accidental exposure of the contents of the fluid delivery device to children. Several preferred embodiments of the present invention are described below with reference to the drawings.

Figure 1:
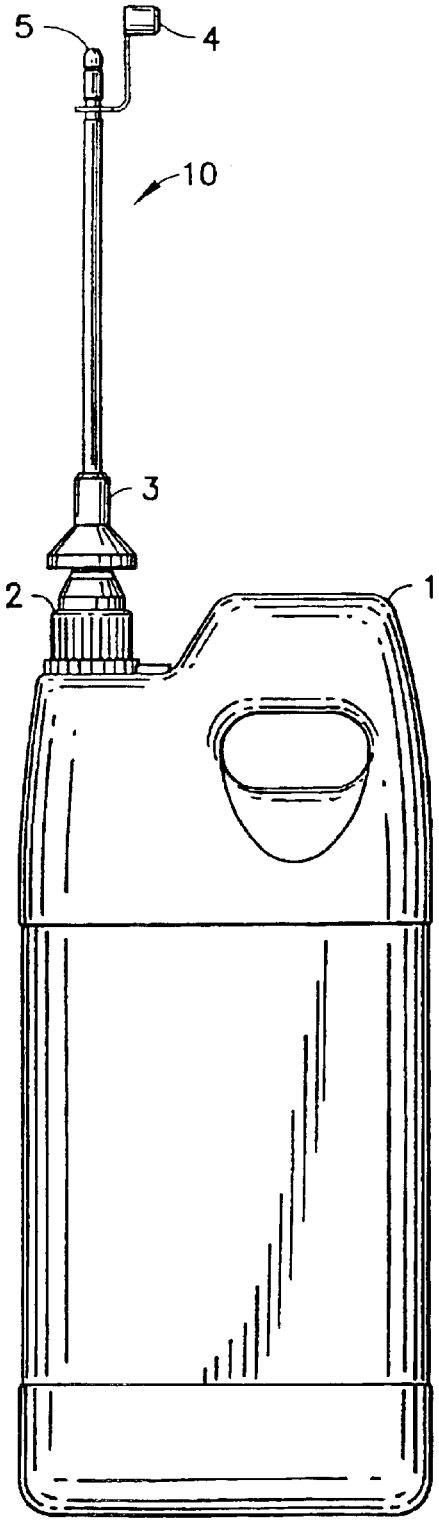
FIG. 1 is a side elevational view illustrating an assembled fluid delivery device in accordance with one embodiment of the present invention.
Figure 2:
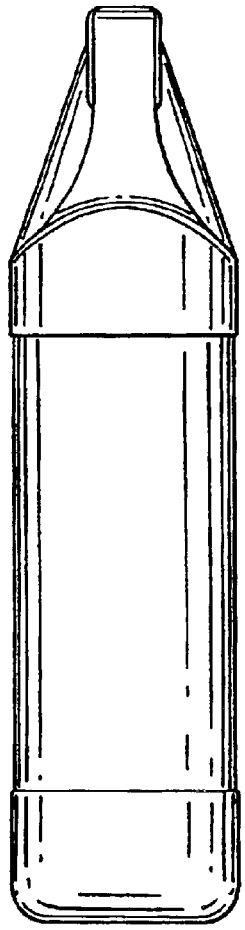
FIG. 2 is a rear elevational view of the container of the fluid delivery device illustrated in FIG. 1.

Referring to FIGS. 1 & 2, there is shown an assembled fluid delivery device in accordance with the present invention. The fluid delivery device comprises a container 1, such as, for example, a ½ gallon capacity plastic, blow molded bottle or container shaped generally to enhance flexure properties. It is understood, however, that the present invention is not limited to any particular size or shape of the container 1, and that other size and shapes of the container are equally applicable to the present invention.

Attached to the container 1 is a wand assembly 10 comprising a child-resistant, non-removable cap 2, a valve or shut-off 3 for controlling the flow of fluid through the wand assembly, a child-resistant safety cover 4, and a nozzle 5 that may be threaded or otherwise fixed onto a distal end of the wand assembly 10 for directing the flow of fluid from the fluid delivery device.

Figure 3:
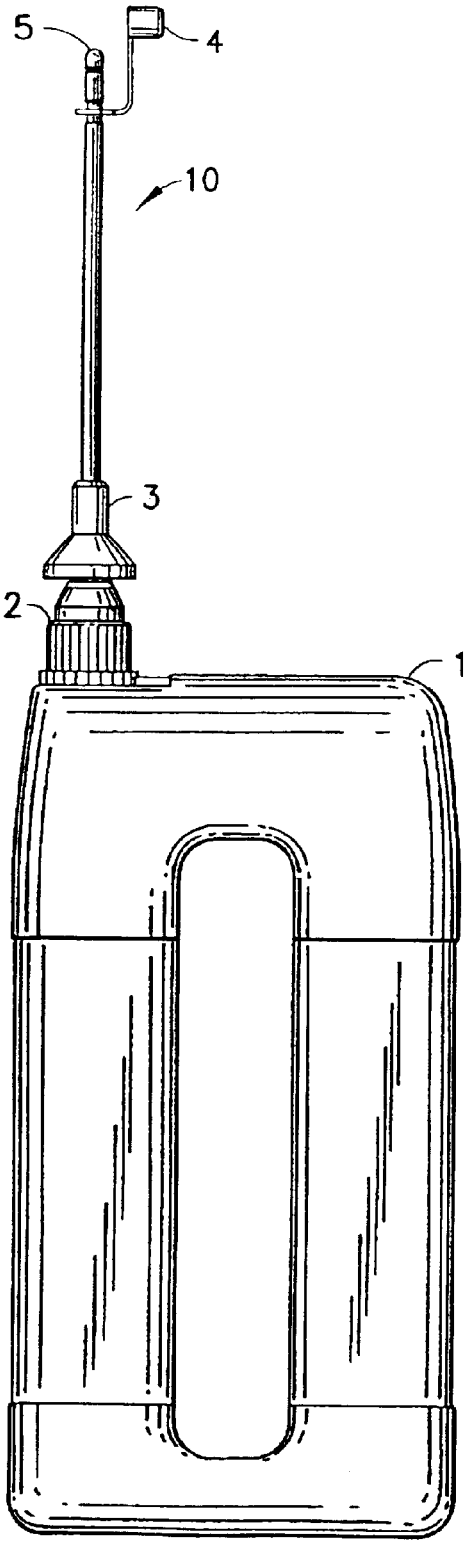
FIG. 3 is a side elevational view illustrating an assembled fluid delivery device in accordance with another embodiment of the present invention.
Figure 4:
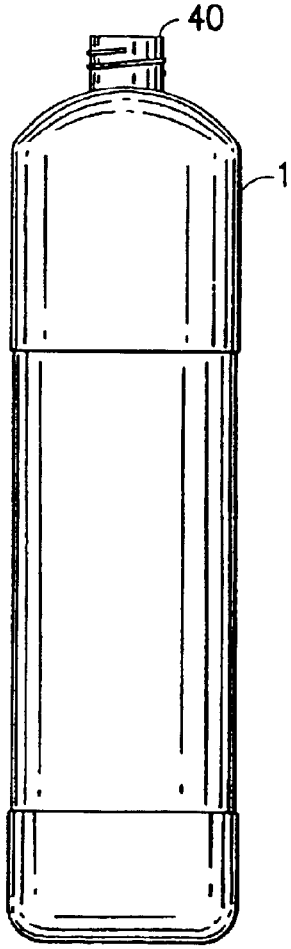
FIG. 4 is a rear elevational view of the container of the fluid delivery device illustrated in FIG. 3.

FIGS. 3 and 4 illustrate an alternative embodiment of the container 1 incorporating a central opening through the container to facilitate handling by the user of the fluid delivery device. The wand assembly 10, including the child-resistant cap 2, valve 3, child-resistant safety cover 4, and nozzle 5 are the same as those illustrated in FIG. 1.

FIG. 4 illustrates the container 1 with a fill spout 40 having an opening into the interior of the container 1. The container 1 may be filled with the desired fluid or solution through the opening in the fill spout 40. The fill spout 40 is preferably externally threaded to facilitate sealing of the container 1 and/or attachment of the wand assembly 10 to the container 1 using the child-resistant cap 2.

Figure 5:
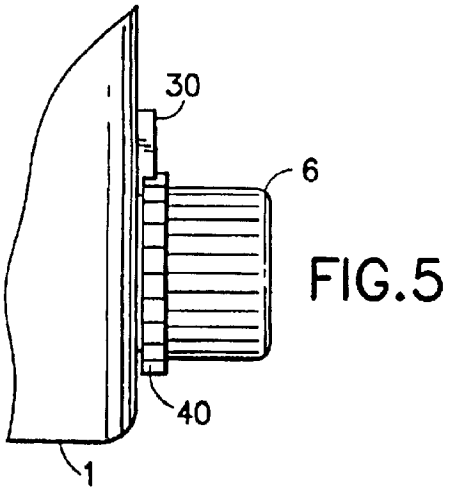
FIG. 5 is a side elevational view illustrating a shipping cap on the container of FIG. 2 or 4.
Figure 6:
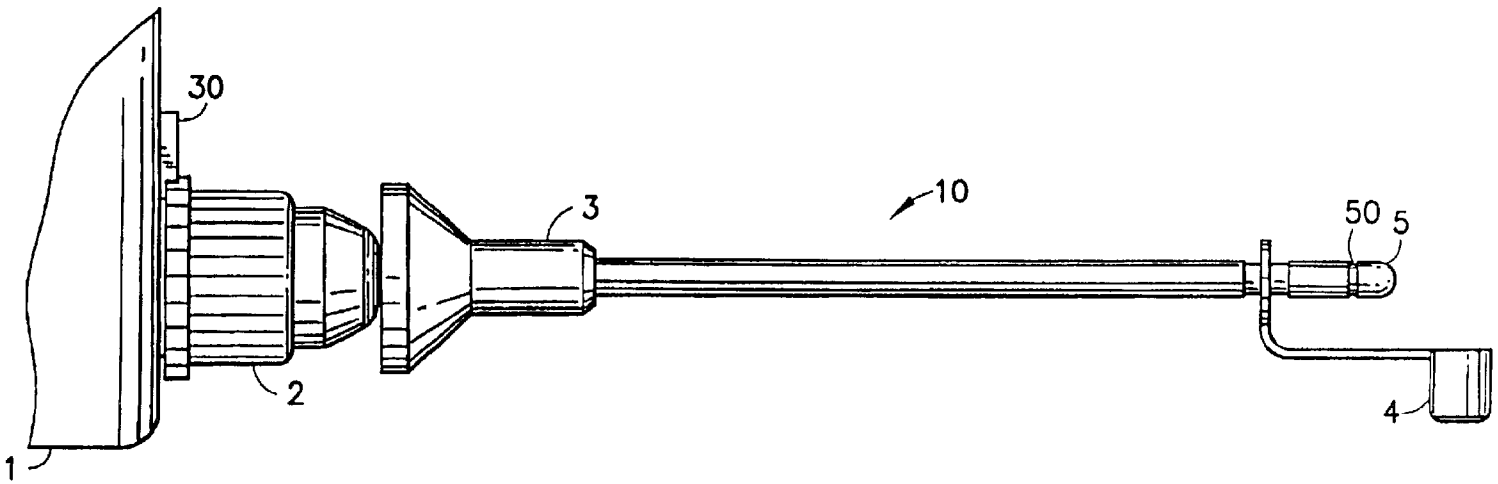
FIG. 6 is a side elevational view illustrating a child-resistant wand assembly in accordance with the present invention connected to the container of FIG. 2 or 4.
Figure 7:
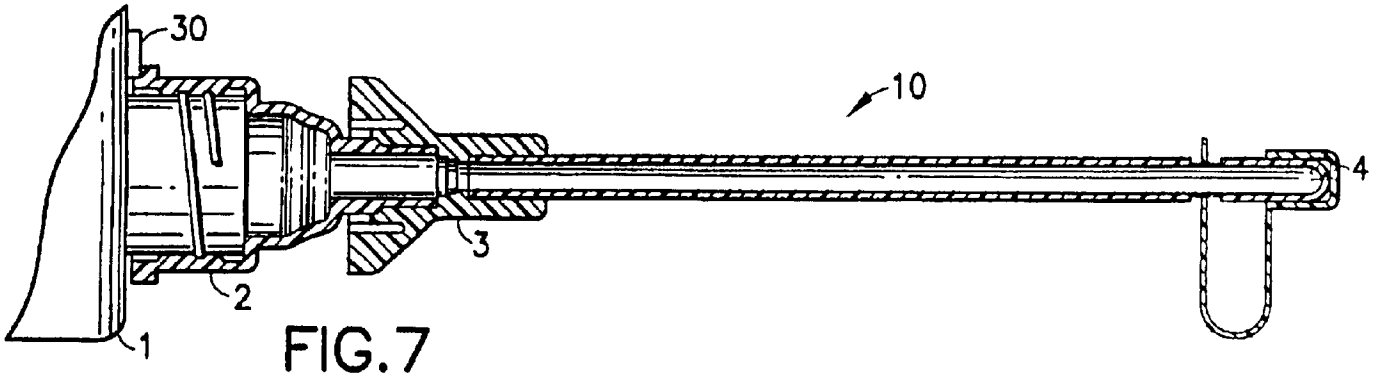
FIG. 7 is a cross-sectional view of the child-resistant wand assembly of FIG. 6.

Referring to FIG. 5, the container 1 may be provided with a removable shipping cap 6 to temporarily seal or close the opening in the fill spout 40. The view shown in FIG. 5 illustrates a non-child resistant version of a shipping cap 6, which may be provided with a child-resistant shrink band or overwrap to prevent a child or other person from accidentally removing the shipping cap 6 and exposing herself to the contents of the container. Alternatively, a child-resistant shipping cap using concepts discussed below may be substituted for the cap 6 to prevent a child or other person from accidentally removing the cap and exposing herself to the contents of the container.

FIGS. 6–16 illustrate the details of the wand assembly 10 in accordance with the present invention and its connection to the container 1. The wand assembly 10 is preferably provided as a pre-assembled unit, which includes the child-resistant cap 2, valve 3, child-resistant safety cover 4, and nozzle 5.

Figure 8:
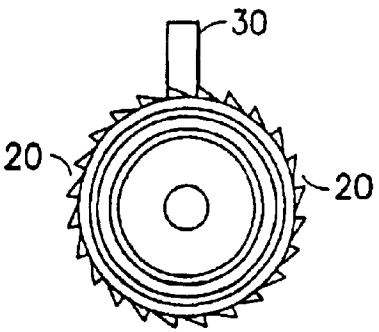
FIG. 8 is a top view of the child-resistant wand assembly of FIG. 6.
Figure 14:
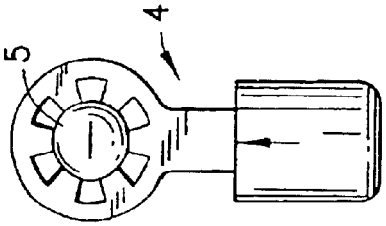
FIG. 14 is an enlarged view of the child-resistant cover of FIG. 9.
Figure 12:
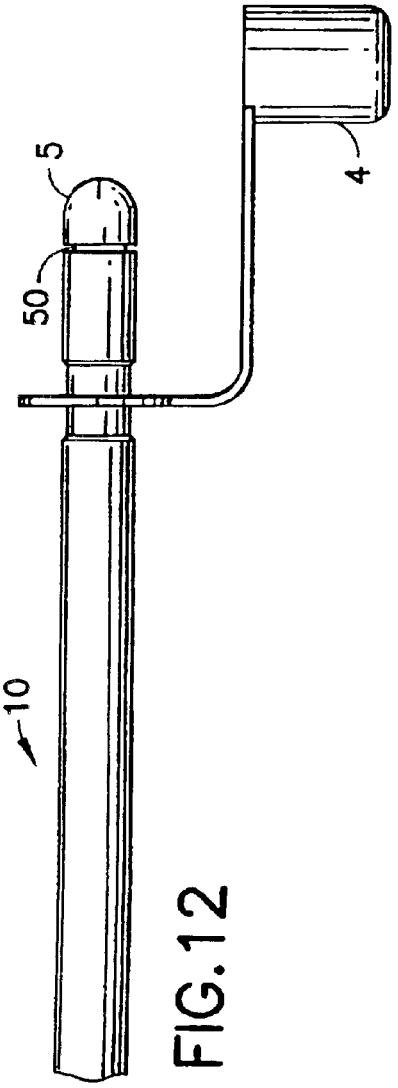
FIG. 12 is an enlarged view illustrating the distal portion of the wand assembly of FIG. 6.
Figure 13:
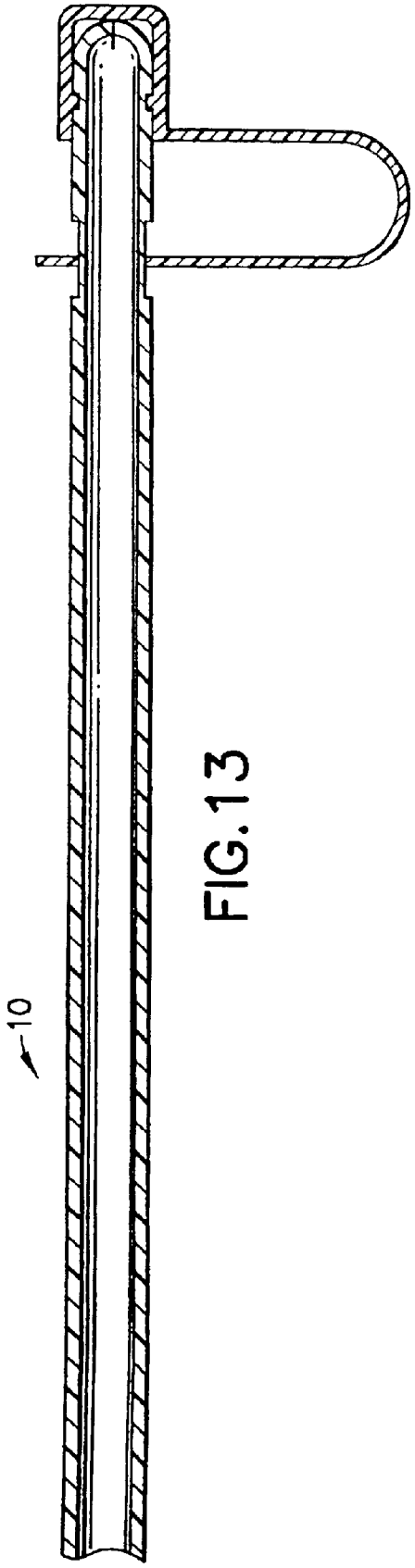
FIG. 13 is an enlarged view of the distal portion of the wand assembly of FIG. 7.
Figure 16:
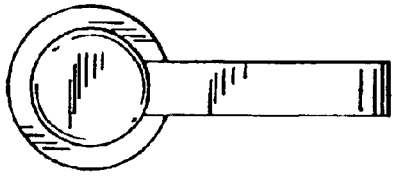
FIG. 16 is an enlarged view of FIG. 11.

Like the shipping cap 6, the child-resistant cap 2 is provided with internal threads for attachment to the fill spout 40 of the container 1. As best illustrated in FIG. 8, the child-resistant cap 2 is also provided with a ratchet mechanism 20 having a plurality of teeth about its perimeter to engage one or more rigid tabs 30 formed on the container 1 in proximity to the fill spout 40. The ramping on the teeth of the ratchet mechanism 20 prevents reverse rotation and removal of the child-resistant cap 2 once the cap is threaded onto the fill spout 40 of the container 1. In this manner, it is intended that a child (or possibly even an adult) will have significant difficulty removing the cap 2 after the cap and wand assembly 10 have been installed on the container 1.

The wand assembly 10 also includes a valve or shut-off 3 for controlling the flow of fluid from the container 1 through the wand assembly. The valve or shut off 3 is opened by pushing it slightly away from the container 1, thereby permitting fluid contained within the container 1 to flow under pressure through the valve 3 and wand assembly 10. The valve or shut-off 3 is closed by retracting the valve 3 back to its original position closest to the container 1, thereby preventing fluid stored within the container 1 from flowing through the valve 3 and wand assembly 10. It is understood that other types of valves may be substituted for the push-pull valve 3 illustrated in the preferred embodiment.

A nozzle 5 is located at the distal end of the wand assembly 10—opposite the end where the child-resistant cap 2 is located—for directing the flow of pressurized fluid from the container 1 and out of the wand assembly 10. Preferably, the nozzle 5 is a flat nozzle optimized for low pressure application. It is understood, however, that other nozzles may be used in conjunction with the wand assembly 10.

As illustrated in FIGS. 6, 7 and 9–16, a removable, child-resistant safety cover 4 is provided at the distal end of the wand assembly 10 near the nozzle 5. The child-resistant safety cover 4 preferably snaps over the nozzle 4 and one or more projecting tabs formed within the interior of the cover 5 engage and are retained within a groove or recess 50 formed in the nozzle 5 or distal end of the wand assembly 10 to effect a seal and prevent removal of the child-resistant safety cover 4.

Figure 10:
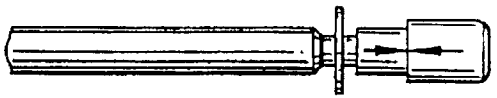
FIG. 10 is a partial side elevational view of the child-resistant cover in an aligned position on the wand assembly of FIG. 6 in accordance with the present invention.
Figure 11:
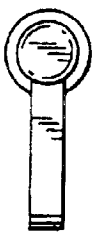
FIG. 11 is a top view of the child-resistant cover in an aligned position on the wand assembly of FIG. 6 in accordance with the present invention.
Figure 9:
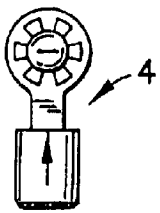
FIG. 9 is a front view of a child-resistant cover for use with the wand assembly of FIG. 6.
Figure 15:
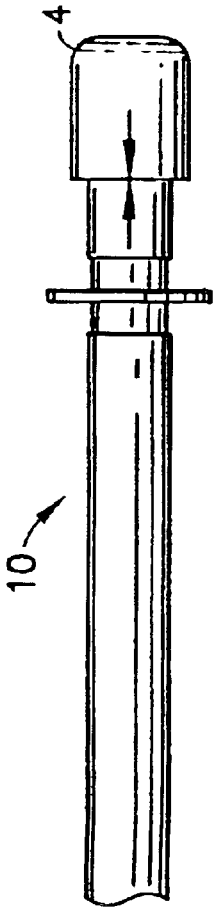
FIG. 15 is an enlarged view of FIG. 10.

To remove the child-resistant safety cover 4, the cover must preferably be rotated about the nozzle 5 and wand assembly 10 to align the arrows or other indicia on the nozzle 5 and child-resistant safety cover 4 as indicated in FIGS. 10 and 15. When the arrows are aligned, the projecting tabs formed within the interior of the cover 4 may pass through relieved sections of the groove or recess 50 formed in the nozzle 5 or wand assembly 10 to permit removal of the child-resistant safety cover 4 from the nozzle 5. An integral tether, strap or band formed on the child-resistant safety cover 4 attaches to the wand assembly 10 so that the cover 4 is not misplaced or otherwise discarded when removed from the nozzle 5.

To use the fluid delivery device in accordance with the preferred embodiment, the user must first remove the child-resistant overwrap and shipping cap 6 (or remove the child-resistant shipping cap if so provided). The wand assembly 10 may then be attached to the container 1 by threading/screwing the child-resistant cap 2 onto the threaded fill spout 40 (or other equivalent feature provided on the container 1 for accessing the interior of the container). The wand assembly 10 cannot be readily removed after installation without damage to the container 1 and/or child-resistant cap 2 due to the engagement of the ratchet mechanism 20 with the rigid tab(s) 30 formed on the container 1.

Before using the fluid delivery device, the child-resistant safety cover 4 must be removed from the nozzle 5 by aligning the arrow (or other identifier) on the nozzle 5 with the arrow (or other identifier) on the cover 4 (FIGS. 10 and 15), thereby permitting the projecting tab(s) formed on the interior of the cover 4 to pass through the relieved portions of the groove 50 formed in the nozzle and allow for removal of the child-resistant safety cover 4. The cover 4 is preferably tethered to the wand assembly to minimize the chance of it being lost or inadvertently discarded.

To use the fluid delivery device, the container 1 should be held in either one or both hands with the nozzle 5 directed downward toward the desired point of application. The valve or shut off 3 is then opened by pushing it slightly away from the container 1 (i.e., in the direction of the nozzle 5). The fluid within the container 1 is then dispensed by, for example, squeezing the container 1 such that fluid under pressure flows from the container through the wand assembly 10 and out of the nozzle 5. The flow of fluid may be stopped by retraction of the valve or shut-off 3 to its original position closest to the container (i.e., moving the valve in the direction away from the nozzle 5). It is understood, however, that an internally mounted piston/pump assembly may be utilized to pressurize the fluid within container 1.

An alternative preferred embodiment is shown in FIGS. 17–28. In this embodiment, the container 1, fill spout 40, shipping cap 6 (FIG. 19), child-resistant, non-removable cap 2 (FIGS. 17, 18 and 20), ratchet mechanism 20, rigid tab(s) 30, and the valve or shut-off 3 (FIGS. 17–18) are the same in design and operation as those described above with respect to the preceding embodiment.

The predominant difference between this and the preceding embodiment concerns the relationship between the nozzle 12 and the child-resistant safety cover 7. The wand assembly 8 of this second embodiment is provided with a nozzle 12 at the distal end of the wand assembly 8, which nozzle is preferably, but not necessarily, integrally formed with the distal end of the wand assembly. Preferably, the nozzle 5 is a flat nozzle optimized for low pressure application. A portion of the nozzle 12 or wand assembly 8 is preferably provided with external threads 14 for engaging internal threads formed within the interior of the child-resistant safety cover 7. An adjacent portion of the nozzle 12 or wand assembly 8 is also preferably provided with a ratchet mechanism 16 whose teeth engage one or more tabs (FIGS. 27 and 28) projecting from the interior of the child-resistant safety cover 7.

Figure 17:
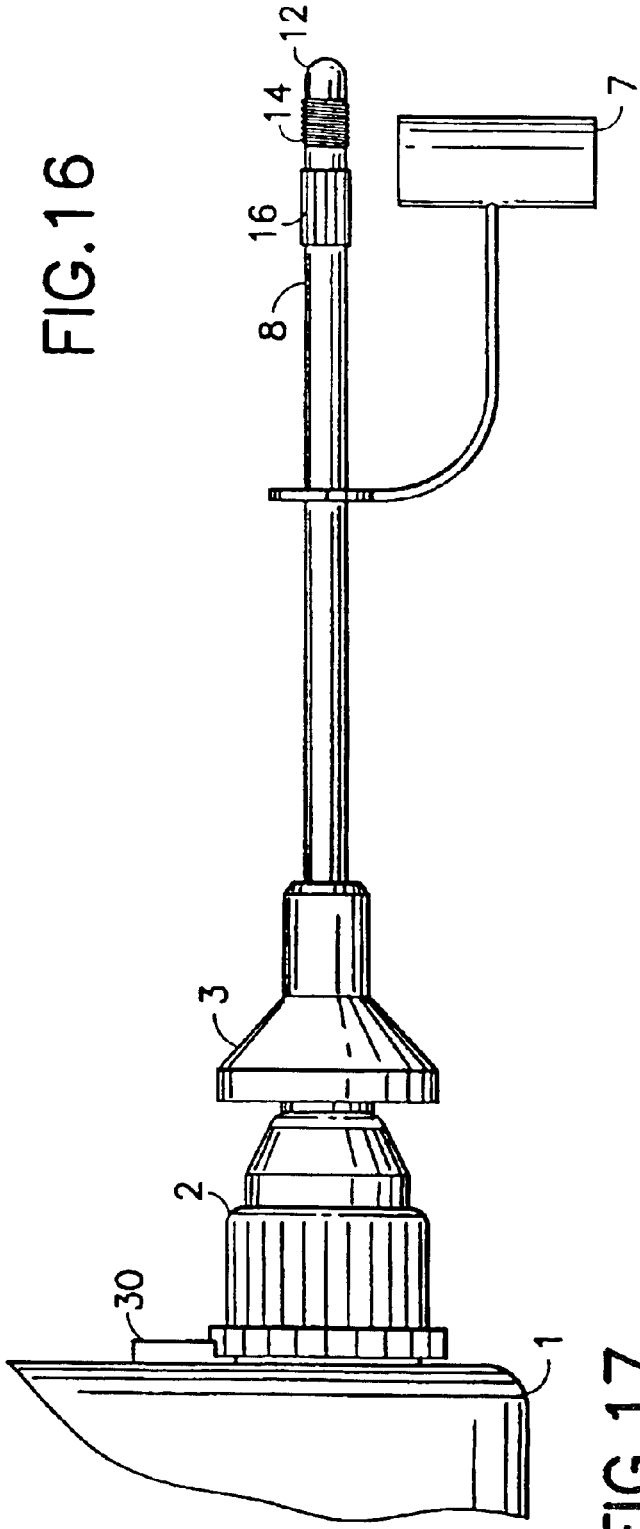
FIG. 17 is a side elevational view illustrating another embodiment of a child-resistant wand assembly in accordance with the present invention connected to the container of FIG. 2 or 4.
Figure 18:
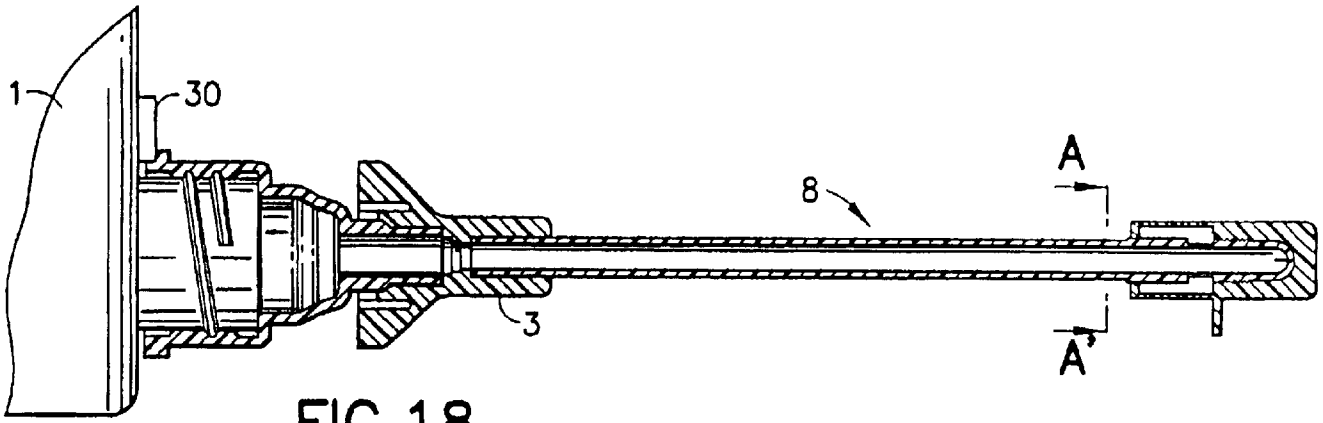
FIG. 18 is a cross-sectional view of the child-resistant wand assembly of FIG. 17.
Figure 21:
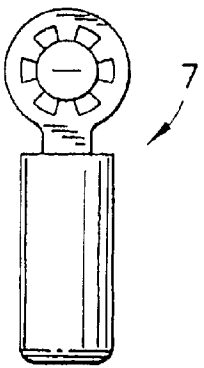
FIG. 21 is a front view of another embodiment of a child-resistant cover for use with the wand assembly of FIG. 17.
Figure 23:
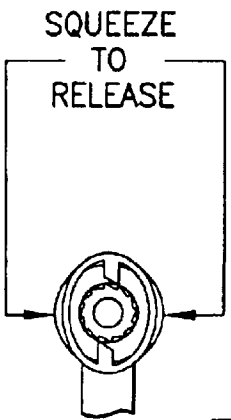
FIG. 23 is a cross-sectional view of the child-resistant wand assembly and cover in an unlocked position taken across line A—A of FIG. 18.
Figure 22:
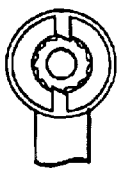
FIG. 22 is a cross-sectional view of the child-resistant wand assembly and cover in a locked position taken across line A—A of FIG. 18.
Figure 19:
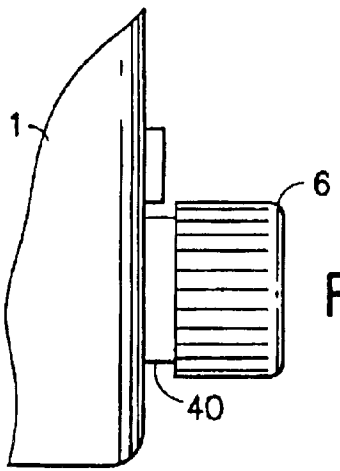
FIG. 19 is a side elevational view illustrating a shipping cap on the container of FIG. 2 or 4.
Figure 20:
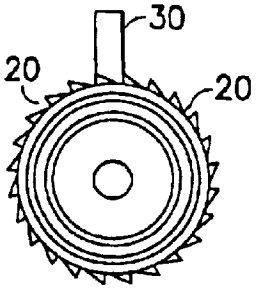
FIG. 20 is a top view of the child-resistant wand assembly of FIG. 17.
Figure 24:
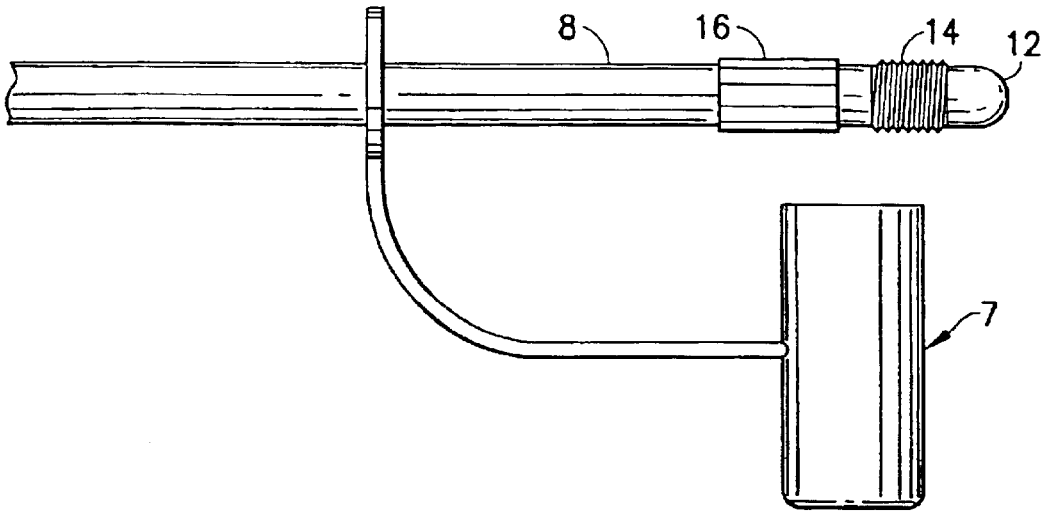
FIG. 24 is an enlarged view illustrating the distal portion of the wand assembly of FIG. 17.
Figure 25:
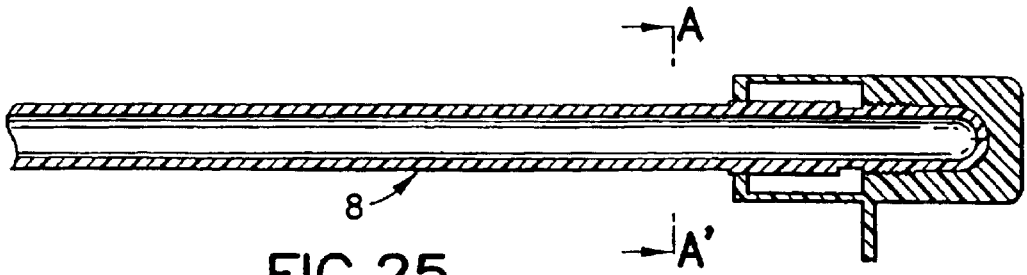
FIG. 25 is an enlarged view of the distal portion of the wand assembly of FIG. 18.
Figure 26:
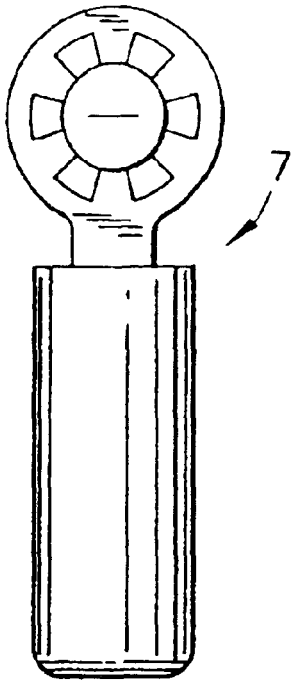
FIG. 26 is an enlarged view of the child-resistant cover of FIG. 21.
Figure 27:
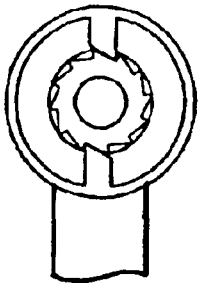
FIG. 27 is an enlarged view of FIG. 22.
Figure 28:
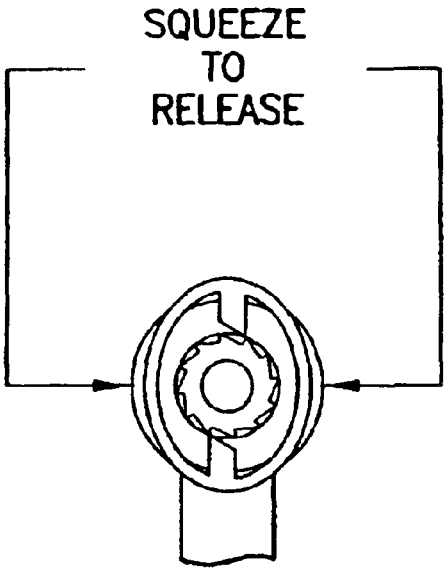
FIG. 28 is an enlarged view of FIG. 23.

In this manner, the child-resistant safety cover 7 may be threaded or screwed onto the nozzle 12 or distal end of the wand assembly 8 to thereby effect a seal and prevent inadvertent removal of the child-resistant safety cover 7 from the nozzle 12. The ratchet mechanism 16 prevents reverse rotation and removal of the child-resistant safety cover 7 unless the cover 7 is squeezed or otherwise deformed to release engagement of the projecting tab(s) on the cover 7 from the ratchet mechanism 16 formed on the nozzle 12 or wand assembly 8. The child-resistant safety cover 7 may be unscrewed or turned to remove the cover 7 from the nozzle 12 when the tab(s) on the cover 7 are released from the ratchet mechanism 16. As illustrated in FIGS. 17 & 24, the cover 7 is preferably tethered to the wand assembly 8 to minimize the chance of it being lost or inadvertently discarded.

With the exception of the removal of the child-resistant safety cover 7 from the nozzle 12, this second embodiment of the invention operates in the same manner as described above with respect to the preceding embodiment.

Although the preferred embodiments describe the fluid delivery device as one that develops pressure by depressing or squeezing the container/device, it is understood that other types of fluid delivery devices are equally applicable to the present invention, including compressions sprayers and the like. Furthermore, it is understood that the present invention may be utilized on one-time use, limited use and reusable fluid delivery devices.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used herein as terms of description and not terms of limitation. There is no intention to use the terms or expressions to exclude any equivalents of features shown and described or portions thereof and this invention should be defined in accordance with the claims that follow.

We claim:

1. A child-resistant fluid delivery device, comprising:

a container for storing fluid to be dispensed by the fluid delivery device;

a wand having a proximal end, a distal end and a fluid passageway therethrough;

a nozzle at the distal end of the wand; and a removable, child-resistant cover for sealing the nozzle, the child-resistant cover including at least one rigid tab inwardly projection into an interior region of the child-resistant cover to resist removal of the cover from the nozzle;

first ratchet mechanism having a plurality of ratchet teeth formed along the circumference of the wand, the ratchet teeth engaging the at least one inwardly projecting tab, the ratchet teeth being configured to permit rotation of the cover relative to the nozzle in a first direction that permits attachment of the cover onto the nozzle and to prevent rotation in an opposing direction to resist removal of the cover from the nozzle.

2. The child-resistant fluid delivery device according to claim 1, wherein internal threads formed in the child-resistant cover engage external threads formed on the nozzle to permit the cover to be threaded onto the nozzle.

3. The child-resistant fluid delivery device according to claim 1, wherein the at least one inwardly projecting tab may be disengaged from the ratchet teeth by deforming the child-resistant cover to permit rotation of the cover relative to the nozzle in the opposing direction to remove the cover from the nozzle.

4. The child-resistant fluid delivery device according to claim 1, further comprising a child-resistant connector at the proximal end of the wand for connecting the wand to the container.

5. The child-resistant fluid delivery device according to claim 4, further comprising a second ratchet mechanism formed on the exterior of the child-resistant connector to permit attachment of the connector to the container and thereafter resist removal of the connector from the container.

6. The child-resistant fluid delivery device according to claim 5, wherein the second ratchet mechanism comprises a plurality of ratchet teeth formed about the perimeter of the child-resistant connector for engaging at least one rigid tab formed on the container, the teeth being configured to permit movement of the child-resistant connector relative to the container in a first direction and to resist such movement in an opposing direction.

7. The child-resistant fluid delivery device according to claim 4, wherein the container includes an externally threaded spout for engaging internal threads formed within the child-resistant connector.

8. The child-resistant fluid delivery device according to claim 1, wherein the fluid passageway in the wand provides a fluid communication path for fluid to pass from the container to the nozzle.

9. The child-resistant fluid delivery device according to claim 1, further comprising a valve for controlling the flow of fluid through the wand.

10. The child-resistant fluid delivery device according to claim 9, wherein the valve is movable from a first position that prevents the flow of fluid through the wand to a second position that permits the flow of fluid through the wand.

11. The child-resistant fluid delivery device according to claim 1, wherein the nozzle is formed integrally with the distal end of the wand.

12. The child-resistant fluid delivery device according to claim 1, wherein the nozzle is threaded onto the distal end of the wand.

13. The child-resistant fluid delivery device according to claim 1, wherein the child-resistant cover is tethered to the wand.

14. The child-resistant fluid delivery device according to claim 1, further comprising a pump for pressurizing the fluid within the container.

15. The child-resistant fluid delivery device according to claim 1, wherein the fluid within the container is pressurized by squeezing the container.

16. A wand assembly for a child-resistant fluid delivery device that includes a container for storing fluid to be dispensed by the fluid delivery device, the wand assembly comprising:

a tube having a proximal end, a distal end and a fluid passageway therethrough;

a nozzle at the distal end of the tube; and a removable, child-resistant cover for sealing the nozzle, the child-resistant cover including at least one rigid tab inwardly projecting into an interior region of the child-resistant cover to resist removal of the cover from the nozzle;

a ratchet mechanism having a plurality of ratchet teeth formed along the circumference of the tube, the ratchet teeth engaging the at least one inwardly projecting tab, the ratchet teeth being configured to permit rotation of the cover relative to the nozzle in a first direction that permits attachment of the cover onto the nozzle and to prevent rotation in an opposing direction to resist removal of the cover from the nozzle.

17. The wand assembly according to claim 16, wherein internal threads formed in the child-resistant cover engage external threads formed on the nozzle to permit the cover to be threaded onto the nozzle.

18. The wand assembly according to claim 16, wherein the at least one inwardly projecting tab may be disengaged from the ratchet teeth by deforming the child-resistant cover to permit rotation of the cover relative to the nozzle in the opposing direction to remove the cover from the nozzle.

19. The wand assembly according to claim 16, further comprising a connector at the proximal end of the tube adapted to connect the wand assembly to the container.

20. The wand assembly according to claim 19, further comprising a second ratchet mechanism formed on the exterior of the connector for permitting attachment of the connector to the container and thereafter resisting removal of the connector from the container.

21. The wand assembly according to claim 20, Wherein the second ratchet mechanism comprises a plurality of ratchet teeth formed about the perimeter of the connector for engaging at least one rigid tab formed on the container, the teeth being configured to permit movement of the connector relative to the container in a first direction and to resist such movement in an opposing direction.

22. The wand assembly according to claim 16, further comprising means for connecting the wand assembly to the container.

23. The wand assembly according to claim 19, wherein the connector includes internal threads for engaging external threads formed on the container.

24. The wand assembly according to claim 16, wherein the fluid passageway in the tube provides a fluid communication path for fluid to pass from the container to the nozzle.

25. The wand assembly according to claim 16, further comprising a valve for controlling the flow of fluid through the fluid passageway.

26. The wand assembly according to claim 25, wherein the valve is movable from a first position for preventing the flow of fluid through the fluid passageway to a second position for permitting the flow of fluid through the fluid passageway.

27. The wand assembly according to claim 16, wherein the nozzle is formed integrally with the distal end of the tube.

28. The wand assembly according to claim 16, wherein the nozzle is threaded onto the distal end of the tube.

29. The wand assembly according to claim 16, wherein the child-resistant cover is tethered to the tube.

* * * * *

UNITED STATES PATENT AND TRADEMARK OFFICE

CERTIFICATE OF CORRECTION

PATENT NO. : 6,796,462 B2
DATED : September 28, 2004
INVENTOR(S) : William A. Hudson and Raymond Cracauer It is certified that error appears in the above-identified patent and that said Letters Patent is hereby corrected as shown below:

Column 6,
Line 19, "inwardly projection into an interior region of the child-" should read -- inwardly projecting into an interior region of the child- --.

Column 8,
Line 1, "Wherein" should read -- wherein --.

Signed and Sealed this

First Day of February, 2005

JON W. DUDAS
*Director of the United States Patent and Trademark Office*